US007201331B2

(12) United States Patent
Bertrand

(10) Patent No.: US 7,201,331 B2
(45) Date of Patent: Apr. 10, 2007

(54) SHOWER DEVICE

(76) Inventor: Steven Bertrand, 28 Lillian Ter., Dracut, MA (US) 01826

( * ) Notice: Subject to any disclaimer, the term of this patent is extended or adjusted under 35 U.S.C. 154(b) by 0 days.

(21) Appl. No.: 09/734,003

(22) Filed: Dec. 12, 2000

(65) Prior Publication Data

US 2002/0070294 A1 Jun. 13, 2002

(51) Int. Cl.
*B05B 7/30* (2006.01)

(52) U.S. Cl. ..... 239/318; 239/310; 239/304; 239/305

(58) Field of Classification Search ..... 239/302–306, 239/310, 318, 317, 311; 4/605
See application file for complete search history.

(56) References Cited

U.S. PATENT DOCUMENTS 2,743,913 A * 5/1956 Gundlach ..... 239/311
3,071,081 A * 1/1963 Mullick ..... 138/46
3,079,093 A 2/1963 Bellows
3,207,445 A 9/1965 Court et al.
3,231,200 A * 1/1966 Heald ..... 239/318
3,254,647 A 6/1966 Vogel
3,357,598 A 12/1967 Kraft
3,628,732 A * 12/1971 Vicari ..... 239/310
4,121,773 A * 10/1978 Headen et al. ..... 239/317
4,131,232 A 12/1978 Pollinzi
4,193,520 A * 3/1980 Duffield ..... 222/133
4,322,036 A * 3/1982 Bly ..... 239/311
4,623,095 A * 11/1986 Pronk ..... 239/311
4,956,883 A * 9/1990 Lane ..... 4/605
5,071,070 A * 12/1991 Hardy ..... 239/311
5,333,789 A * 8/1994 Garneys ..... 239/318
5,356,076 A * 10/1994 Bishop ..... 239/311
6,045,060 A * 4/2000 Hudson ..... 239/310

* cited by examiner

*Primary Examiner*—James Hook
(74) *Attorney, Agent, or Firm*—Michael L Greenberg, Esq; Greenberg & Lieberman LLC

(57) ABSTRACT

The present invention is a shower device which simplifies the showering process by allocating soap, moisturizers, fragrances, and other detergent-type fluids through a shower head using the venturi concept so as to integrate the substance with the regularly dispensed water flow.

14 Claims, 2 Drawing Sheets

SHOWER DEVICE

Priority is hereby claimed to Provisional Patent Application Ser. No. 60/290,635, filed on Jun. 6, 2000.

FIELD OF THE INVENTION

The present invention is relevant to a shower device which incorporates a system of drawing various solutions used during or after a shower from reservoirs and dispensing them through the shower unit to the showerhead.

BACKGROUND OF THE INVENTION

An individual's morning routine is often hectic, especially if it must be coordinated with other members of the family who are all sharing valuable time in the bathroom. The process of showering and moisturizing can often be a time-consuming process that most people who are rushing to work or school in the morning would like to shorten and even consolidate.

U.S. Pat. No. 3,079,093 issued to R. Bellows on Feb. 26, 1963 describes a combination liquid soap dispenser and water spout that can be employed in a sink or a bathtub to make a bubble bath. This invention uses an integral reservoir and spout in which the soap is stored completely within the spout. Unlike the present invention, the bubble bath is stored entirely within the spout and the force of gravity is used to dispense the liquid into the water stream. The bubble bath is dispensed from the water spout of the bath tub and not the shower head rendering Bellows's device unsuitable for the purposes of the present invention.

U.S. Pat. No. 4,131,232 issued to Pollinzi on Dec. 26, 1978 illustrates a device in which one liquid can be dispensed in controlled amounts to shower water through the use of a plastic container which is positioned above the shower head. A valve is placed on the mouth of the dispensing container and the contents within are dispensed through the force of gravity. Unlike the present invention, this device does not use the Venturi concept to draw liquid from a reservoir.

U.S. Pat. No. 3,357,598 issued to Kraft on Dec. 12, 1967 describes a liquid dispenser which mixes liquid concentrate with pressurized liquid and uses a mechanism to mix the two substances. Unlike the present invention, Kraft's device has been developed for use with household refrigerators and the production of various beverages.

U.S. Pat. No. 3,254,647 issued to V. J. Vogel on Jun. 7, 1966 is concerned with a device which may be attached to a faucet spout that acts as a flow restrictor by exerting a positive back pressure. The intention of this device is to mix the dispensed water with disinfectants or medicaments that may be used in a douche device. Unlike the present invention, Vogel's invention is attachable to the spout of a standard water faucet rather than a shower head. Additionally, Vogel's device does not make use of the Venturi concept to mix the two substances.

U.S. Pat. No. 3,207,445 issued to Frank B. Court and Herbert J. Miller on Sep. 21, 1965 is relevant to a shower bath device which dispenses an aerated soap and water mixture. The device operates by use of an air inlet within a conduit system which allows the soap and water to combine in a mixing chamber. Unlike the present invention, water is introduced to a given amount of solution, therefore diluting the solution until it has been completely dispensed rather than introducing the solution into the water stream as the present invention does. Additionally, Court and Miller's device does not utilize the Venturi system to combine the substances.

SUMMARY OF THE INVENTION

The present invention contains a mechanism used to draw a liquid into a supply hose so that it can be combined with water and discharged through the shower head. A given number of reservoirs are attached to a shower unit by a connecting supply hose. A various number of liquids can be stored in the reservoirs such as lotion, baby oil, shampoo, conditioner, aromas or shower gel. The solution dilution ratio will vary based on the viscosity of the solution placed in the reservoir.

DETAILED DESCRIPTION OF THE PREFERRED EMBODIMENT(S)

The present invention with attached solution reservoirs has a shower unit, and optionally, a supply hose, solution reservoirs, and a reservoir holder. The shower unit with attached solution reservoirs can be used with a conventional shower pipe.

Figure 1:
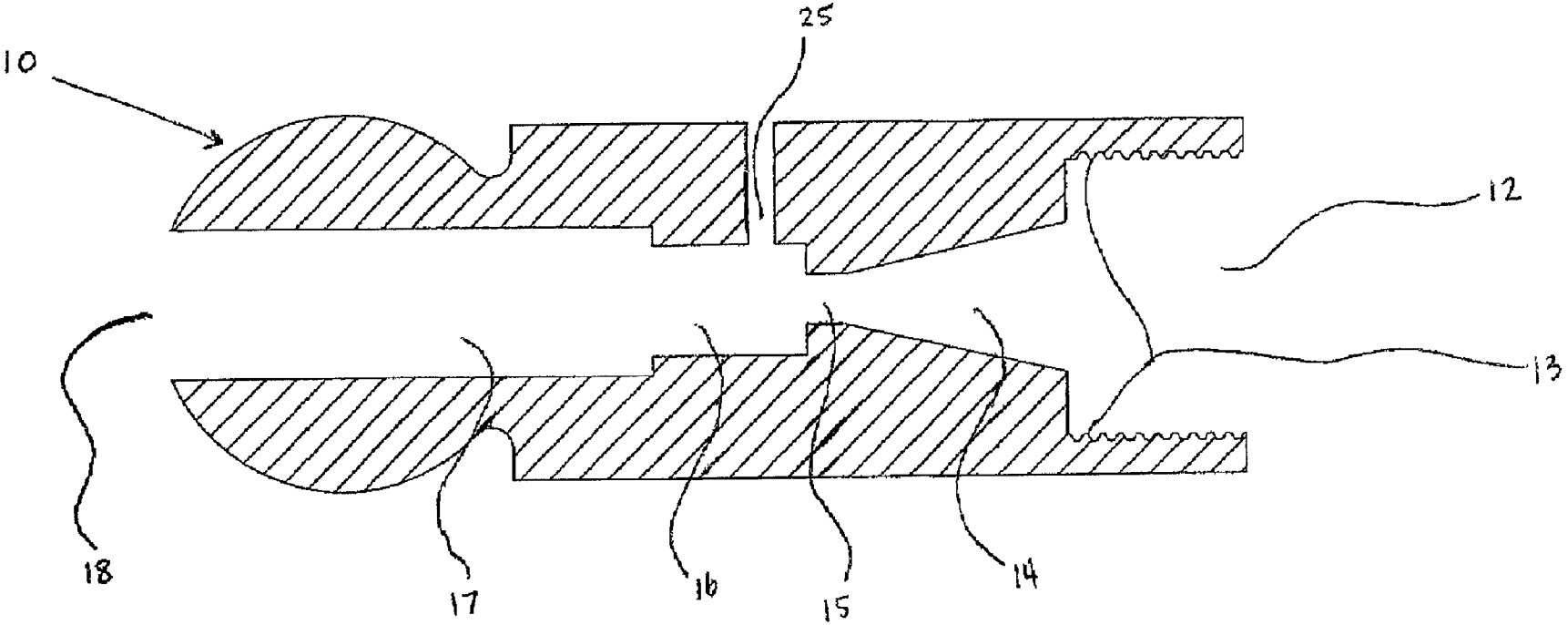
FIG. 1 shows a cross-section view of the present invention.

FIG. 1 shows a cross-sectional view of the shower unit. FIG. 1 illustrates shower unit (10) which attaches to a conventional shower pipe (not shown). There are several structural variations within the present invention which serve to facilitate the desired movement of water. A first region (12) exists on the right side of the shower unit (10) which communicates with a standard shower pipe (not shown). The first region (12) is exhibited as cylindrical in shape. The shower unit (10) is slightly larger than the conventional shower pipe. The first region (12) has a threaded female adaptor (13) which attaches to the outside diameter threads of the conventional shower pipe (not shown) thereby holding the shower unit (10) in place by the conventional method.

To the left of the first region (12), there is a communication with a second region (14), the next subsequent region of the shower unit (10). The second region (14) in this embodiment is conical in shape. The second region (14) has a constricted diameter and its purpose is to increase the velocity of the water traveling through the shower unit (10). At one point in the length of the inner tube of the shower unit (10), there is a porting region (15). In the porting region (15) the reduced diameter causes maximal increase in velocity of the water. In the preferred embodiment, the second region (14) is 0.420 inches in diameter at its wide end, and continually narrows as it approaches the porting region (15) which is 0.140 inches diameter. The angle at which the second region (14) constricts toward the porting region (15) is 12.5 degrees.

After passing through the second region (14), the water moves into a third region (16), which is cylindrical in shape. The width of the third region (16) is adequate to allow a high-velocity jet stream of water to flow through as well as leave a space for air within the third region (16). An inlet (25) is also shown which serves as an inlet as well as a point of connection between the shower unit (10) and a solution apparatus. Also as an attachment to the inlet (25) is a tube (31). The tube (31) is a hollow short cylinder which fits within diameter of the inlet (25) to create a straw attachment that the supply tube (not shown) may adhere to.

The solution apparatus exhibits a mechanism for transferring solution such as soap or shampoo through a supply hose (20) into the inlet (25) and the third region (16) (see FIG. 2) Solution will enter the shower unit (10) at the point where the inlet (25) communicates with the third region (16). In the preferred embodiment, the inlet (25) is 0.078 inches in diameter. The solution is drawn into the third region (16) by a vacuum force naturally created by the jet stream of water moving past the inlet (25), a phenomenon known as a venturi action. The third region (16) provides a space for the water and soap solution to combine together. The positioning and size of regions (14, 15, 16, and 17) and the inlet (25) are relative to the success of the venturi action.

After passing through the third region (16), water enters a fourth region (17) that has a slightly larger diameter than third region (16). The fourth region (17) exists in this embodiment as a continuation of the cylindrical shape of the third region (16). In the preferred embodiment, third region (16) is 0.312 inches in diameter, and fourth region (17) is 0.420 inches in diameter. The diameter of the fourth region (17) is the largest in order to account for potential backflow of water when the water reaches the point of dispersal (18).

Figure 2:
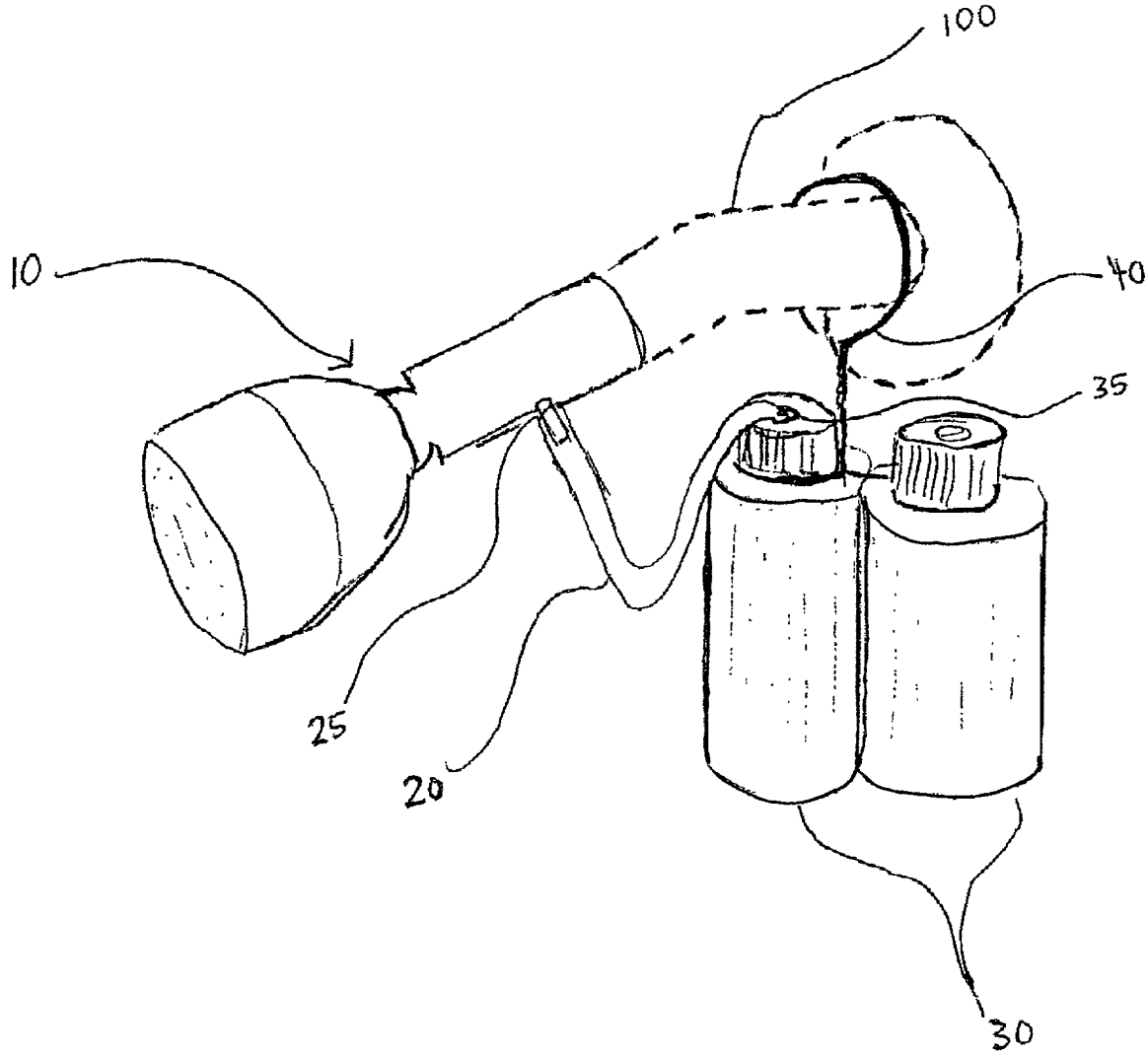
FIG. 2 shows an external side view of the present invention.

FIG. 2 shows the present invention with attached solution reservoirs from an external side view. The shower unit (10) is attached to the conventional shower pipe (100). The shower pipe supports a reservoir holder (40) which, in the present figure, holds two solution reservoirs (30). However, any number of reservoirs may be contained within the holder (40). The solution reservoirs (30) have caps which have an aperture (35). The aperture (35) is an opening through which the supply hose (20) may enter the reservoir (30). The aperture (35) is slightly larger than the diameter of the supply hose (20) so as to allow air passage. The supply hose (20) is of adequate length to reach the bottom of the reservoir. The supply hose (20) connects the shower head unit (10) and the reservoirs (30).

Inlet (25) allows the supply hose (20) to connect the shower unit (10) to the solution reservoir (30). Internally, the shower unit (10) is directly connected to the standard shower pipe (100) normally found in the shower. The shower unit (10) contains a constricted, throat-like passage which serves to increase the velocity of the water transported within. The shower unit (10) itself conforms to water saving specifications of 2.5 gallons per minute as mandated by the requirements establishing water-use restrictions by the Energy Policy and Conservation Act of 1992. The second region (14) will force the given volume of water into a small area, therefore increasing the velocity by which it is dispensed through the shower unit (10).

As the water is being transported through the conventional shower pipe (100), it will enter the second region (14, as shown in FIG. 1), in the shower unit (10) causing an increase in water velocity. The inlet (25) in the shower unit (10), which is connected to the supply hose (20) externally, is bypassed internally by the rapidly moving stream of water through the shower unit (10). The rapid movement of water within the shower unit (10) creates a vacuum which draws the solution from the solution reservoirs (30), which are connected to the other end of the supply hose (20). This vacuum draws the solution from the reservoirs (30) into the shower unit (10). This phenomenon, known as the venturi concept, is applied to draw solution into the shower unit (10) against the flow of gravity. The solution is integrated with the simultaneously dispensed water from the shower pipe (100) at a speed fast enough to combine the liquids and create a solution. The constriction in diameter of the second region (14) and porting region (15) is necessary to create the vacuum force that draws the solution from the reservoir into the shower unit (10). As the solution is integrated into the water stream, it combines to form a soapy or moisturizing liquid within the third region (16). Therefore, the solution that is finally discharged from the shower unit (10) at the point of dispersal (18) will provide a convenient means of washing and/or moisturizing and may be personalized to accommodate a person's aroma or fragrance preferences.

The present invention is a shower unit with attached reservoirs, but is not limited exclusively thereto. It is to be understood that the present invention is not limited to the sole embodiment described above, but encompasses any and all embodiments within the scope of the following claims.

I claim:

1. A mixing device for receiving water from a shower pipe, comprising:

a first cylindrical region configured to receive water from the shower pipe;

a shelf, at one end of said first cylindrical region, narrowing the diameter of said first cylindrical region, said shelf configured to receive water from said first cylindrical region, wherein said shelf has a planar surface configured to receive water from said first cylindrical region;

an aperture, on said planar surface, at the center of said planar surface;

said aperture configured to receive water from said first cylindrical region;

a second region that then receives the water, with a gradually narrowing diameter, said second region configured to receive water from said shelf;

a cylindrical porting region that then receives the water, permitting free and unobstructed flow of the water therein, having a diameter no wider than the diameter of said second region, said cylindrical porting region configured to receive water from said second region;

a third region that then receives the water, in communication with said porting region, said third region configured to receive water from said cylindrical porting region, said third region having a greater diameter than said porting region;

an inlet in communication with said third region, said inlet positioned after said third region receives the water from said porting region;

a tube attached to said inlet;

a solution apparatus in communication with said tube; and a point of dispersal of the water, in communication with said third region, said point of dispersal of the water configured to receive water from said third region.

2. A mixing device as in claim 1, wherein said second region is conical in shape.

3. A mixing device as in claim 1, wherein said inlet can intake solution.

4. A mixing device as in claim 1, wherein said porting region increases the velocity of the water.

5. A mixing device as in claim 1, wherein said third region uses a venturi force to combine solution from said solution apparatus with water exiting from said porting region.

6. A mixing device as in claim 1, wherein said solution apparatus has at least one solution reservoir.

7. A mixing device as in claim 6, wherein said at least one solution reservoir holds a solution.

8. A mixing device as in claim 7, wherein said at least one solution reservoir has at least one aperture for release of said solution.

9. A mixing device as in claim 8, wherein said at least one aperture is in communication with a supply hose.

10. A mixing device as in claim 9, wherein said supply hose is attached to said tube, in communication with said inlet.

11. A mixing device as in claim 7, wherein said solution is soap.

12. A mixing device as in claim 7, wherein said solution is shampoo.

13. A mixing device for receiving water from a shower pipe, comprising:

a first cylindrical region configured to receive water from the shower pipe;

a shelf, at one end of said first cylindrical region, narrowing the diameter of said first cylindrical region, said shelf configured to receive water from said first cylindrical region, wherein said shelf has a planar surface configured to receive water from said first cylindrical region;

an aperture, on said planar surface, at the center of said planar surface;

said aperture configured to receive water from said first cylindrical region;

a second region that then receives the water, with a gradually narrowing diameter, said second region configured to receive water from said shelf;

a cylindrical porting region that then receives the water, permitting free and unobstructed flow of the water therein, having a diameter no wider than the diameter of said second region, said cylindrical porting region configured to receive water from said second region;

a third region that then receives the water, in communication with said porting region, said third region configured to receive water from said cylindrical porting region;

an inlet in communication with said third region, said inlet positioned after said third region receives the water from said porting region;

a tube attached to said inlet;

a solution apparatus in communication with said tube; and a fourth region, in communication with and greater than the diameter of said third region, said fourth region configured to receive water from said third region and attach to a conventional showerhead.

14. A mixing device for receiving water from a shower pipe, comprising:

a first cylindrical region configured to receive water from the shower pipe;

a shelf, at one arid of said first cylindrical region, narrowing the diameter of said first cylindrical region, said shelf configured to receive water from said first cylindrical region, wherein said shelf has a planar surface configured to receive water from said first cylindrical region;

an aperture, on said planar surface, at the center of said planar surface;

said aperture configured to receive water from said first cylindrical region;

a second region that then receives the water, with a gradually narrowing diameter, said second region configured to receive water from said shelf;

a cylindrical porting region that then receives the water, permitting free and unobstructed flow of the water therein, having a diameter no wider than the diameter of said second region, said cylindrical porting region configured to receive water from said second region;

a third region that then receives the water, in communication with said porting region, said third region configured to receive water from said cylindrical porting region;

an inlet in communication with said third region, said inlet positioned after said third region receives the water from said porting region;

a tube attached to said inlet;

a solution apparatus in communication with said tube; and a point of dispersal of the water, in communication with said third region, said point of dispersal of the water configured to receive water from said third region.

* * * * *